United States Patent [19]

McHugh

[11] Patent Number: 4,895,178

[45] Date of Patent: Jan. 23, 1990

[54] DEVICE FOR CLEANING A DRAIN

[75] Inventor: George J. McHugh, Broomall, Pa.

[73] Assignee: AGF Manufacturing, Inc., West Chester, Pa.

[21] Appl. No.: 205,214

[22] Filed: Jun. 10, 1988

[51] Int. Cl.[4] ..... B08B 9/02

[52] U.S. Cl. ..... 134/167 C

[58] Field of Search ..... 134/166 C, 167 C, 168 C, 134/169 C; 4/255, 256, 257; 138/90; 166/185, 187; 277/34.6

[56] References Cited

U.S. PATENT DOCUMENTS

| | | | |
|---|---|---|---|
| D. 234,768 | 4/1975 | Warsinger . | |
| 576,945 | 2/1897 | Brenneman | 134/166 C X |
| 1,180,182 | 4/1916 | Petersen | 134/167 C X |
| 1,308,469 | 7/1919 | Amet | 134/167 C X |
| 1,402,504 | 1/1922 | Krause | 4/257 X |
| 1,776,917 | 9/1930 | Macready | 166/185 |
| 2,050,365 | 8/1936 | Moss et al. | 4/256 |
| 2,061,993 | 11/1936 | Baker | 277/34.6 |
| 2,309,697 | 2/1943 | Gunderson | 166/185 |
| 2,312,826 | 3/1943 | Leyden | 4/256 |
| 2,413,997 | 1/1947 | Rosa | 134/167 C |
| 3,109,459 | 11/1963 | Lee, II et al. . | |
| 3,303,800 | 2/1967 | Young . | |
| 3,595,255 | 7/1971 | Mulinex | 134/167 C |
| 3,792,708 | 2/1974 | Tash | 134/167 C |
| 3,802,449 | 4/1974 | Mulinex | 134/167 C |
| 3,840,033 | 10/1974 | Warsinger | 134/167 C |
| 4,475,255 | 10/1984 | Tash | 4/256 |

*Primary Examiner*—Philip R. Coe

*Attorney, Agent, or Firm*—Burns, Doane, Swecker & Mathis

[57] ABSTRACT

An apparatus for use in delivering fluid under pressure to a drain of a given diameter includes a bladder having an inlet end, an outlet end and an expandable wall having an outer diameter which is smaller than the given diameter of the drain when the bladder is unexpanded. The apparatus includes an orifice at the outlet end of the bladder and may be connected at its inlet to a fluid supply source which supplies fluid under pressure to the bladder. The diameter of the orifice is sized relative to the diameter of the inlet to cause a pressure build-up in the bladder sufficient to cause the expansion of the bladder when fluid is supplied to the bladder, and an inner member is provided for directing fluid flow radially outwardly within the bladder toward the expandable wall to facilitate the expansion of the bladder. The apparatus may alternatively be provided with valve means for covering the orifice when the wall is unexpanded and for uncovering the orifice as the wall is expanded.

11 Claims, 3 Drawing Sheets

FIG. 1
(PRIOR ART)
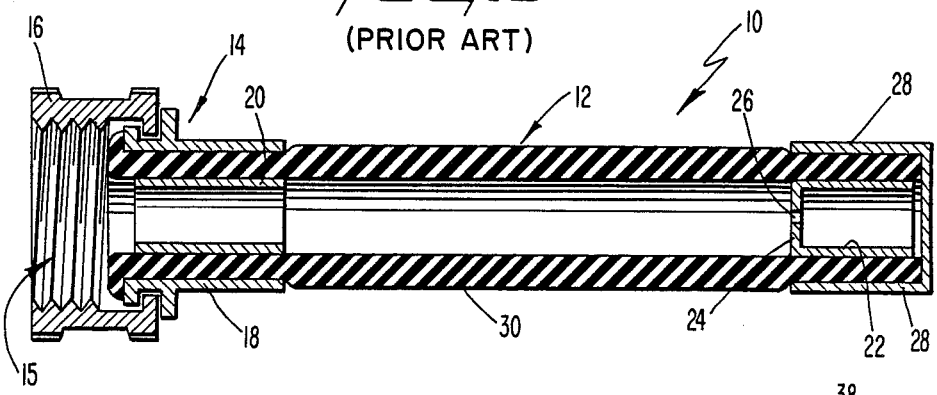
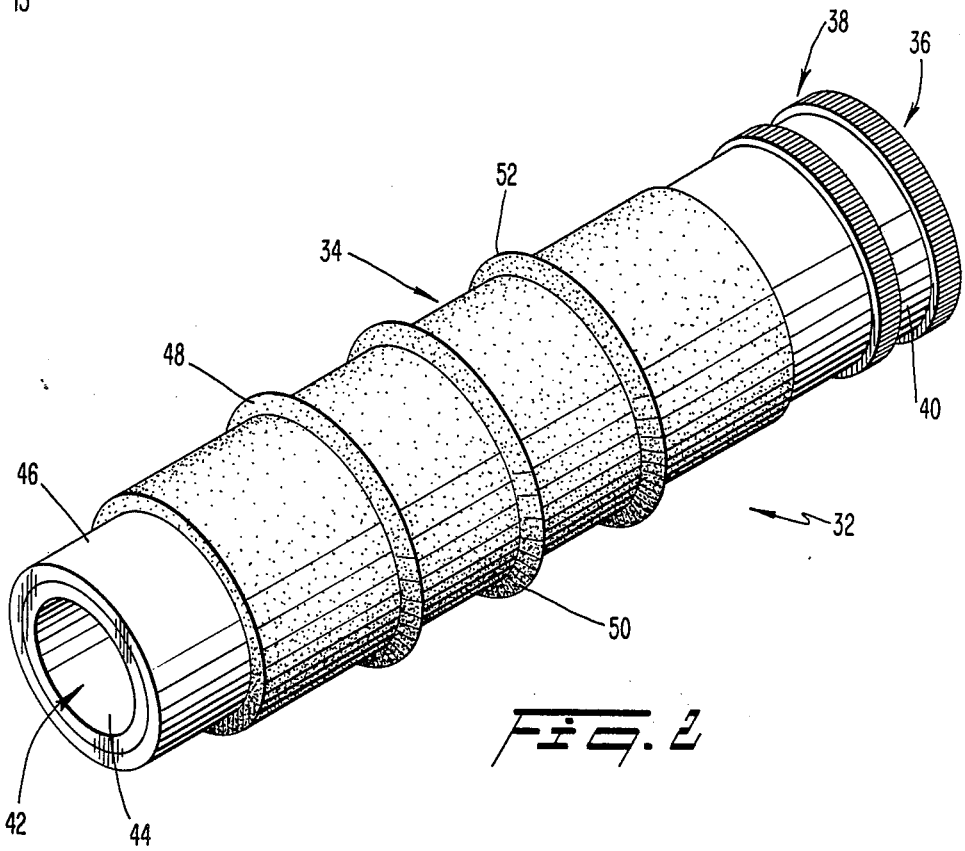
FIG. 2

DEVICE FOR CLEANING A DRAIN

BACKGROUND OF THE INVENTION

1. Field of the Invention

The present invention relates generally to devices for clearing drains and, more particularly, to an apparatus for delivering fluid under pressure to a stopped drain.

2. Discussion of the Prior Art

In order to clear a blocked drain, it is known to employ a hose attachment comprising an expandable bladder and a nozzle. The attachment is commonly placed into a blocked drain and water is delivered through the hose to the attachment and is directed through the nozzle at the clog. A problem encountered with this known device resides in that the expandable bladder, which remains in an unexpanded condition when water is first delivered to the bladder, is supposed to expand after the pressure in the bladder reaches a certain level so as to block off the area around the bladder to cause a pressure buildup in the drain and to prevent water from escaping from the drain and spraying the surrounding area. However, frequently, the bladder fails to expand and such spraying occurs, thus causing users of the device to be sometimes sprayed while attempting to use the device.

One solution to this problem of the bladder not expanding properly has been employed and includes the use of rags or the like stuffed around the device once it is positioned in the drain so that water getting around the unexpanded bladder does not reach the user. However, even when rags are stuffed around the device leakage may still occur and it would be desirable to provide a device which would work properly without any corrective measures being necessary to prevent the user from being sprayed during operation thereof.

OBJECTS AND SUMMARY OF THE INVENTION

It is an object of the present invention to overcome this disadvantage of the prior art device by providing an apparatus for use in delivering fluid under pressure to a drain to clear the drain of clogs, wherein no sealing cloth or additional sealing means is necessary.

Another object of the present invention is to provide an apparatus which comprises an expandable bladder which expands prior to any substantial discharge of fluid from the apparatus to ensure a proper sealing of the apparatus in the drain and to prevent the user from being inadvertently sprayed.

It is yet another object of the invention to provide a drain clearing apparatus which is easy for a single operator to use and which is inexpensive to produce.

The inventive apparatus is used for delivering fluid under pressure to a drain of a given diameter and includes a bladder having an inlet end, an outlet end and an expandable wall having an outer diameter which is smaller than the given diameter of the drain when the bladder is unexpanded. The inlet end includes an inlet having a fixed inlet diameter. Supply connection means are provided for connecting the apparatus to a fluid supply source which supplies fluid under pressure to the inlet and an orifice having a fixed orifice diameter is located at the outlet end of the bladder. The orifice diameter and the inlet diameter are sized relative to one another to cause a pressure buildup in the bladder sufficient to cause the expansion of the expandable wall when fluid is supplied to the bladder. Flow directing means are also included for directing the flow of fluid radially outwardly within the bladder toward the expandable wall, the radially outwardly directed flow facilitating the expansion of the expandable wall of the bladder.

The flow directing means preferably includes a rigid inner member extending from the inlet end of the bladder toward the outlet end of the bladder, the inner member including flow directing passages for directing fluid flow radially outwardly toward the expandable wall of the bladder. In addition, the inner member may be a hollow cylinder having a closed end and a cylindrical wall provided with a plurality of apertures adapted to direct fluid flowing from the inlet of the bladder radially outwardly. The apertures preferably have combined area which is at least as great as the area of the inlet to ensure that the relative sizes of the inlet and orifice effect the pressure build-up in the bladder prior to the discharge of a substantial amount of fluid from the orifice.

In modifications of the inventive apparatus, it is possible to form the apparatus so as to provide a handle by which the apparatus may be handled and to provide a shut-off valve which permits fluid to be delivered to the apparatus without it being activated.

In an alternative embodiment of the inventive apparatus, the bladder is provided with a valve means for closing the orifice when the bladder is unexpanded and for opening the orifice as the bladder is expanded. In this embodiment, when fluid under pressure is supplied to the bladder, the valve mean prevents fluid from flowing through the orifice until after the pressure in the bladder initiates expansion in the bladder.

The valve means preferably is defined by a lip formed in the expandable wall of the bladder which extends radially inwardly of the expandable wall so as to cover the orifice when the bladder is unexpanded. The lip is pulled away from the orifice by the expandable wall when the bladder expands.

BRIEF DESCRIPTION OF THE DRAWINGS

The preferred embodiments of the invention are described in the following detailed description which should be considered in connection with the figures in the accompanying drawings, in which:

FIG. 1 is a side cross-sectional view of an apparatus known in the art;

FIG. 2 is a perspective view of an apparatus constructed in accordance with the present invention;

DETAILED DESCRIPTION OF A PREFERRED EMBODIMENT

Figure 3:
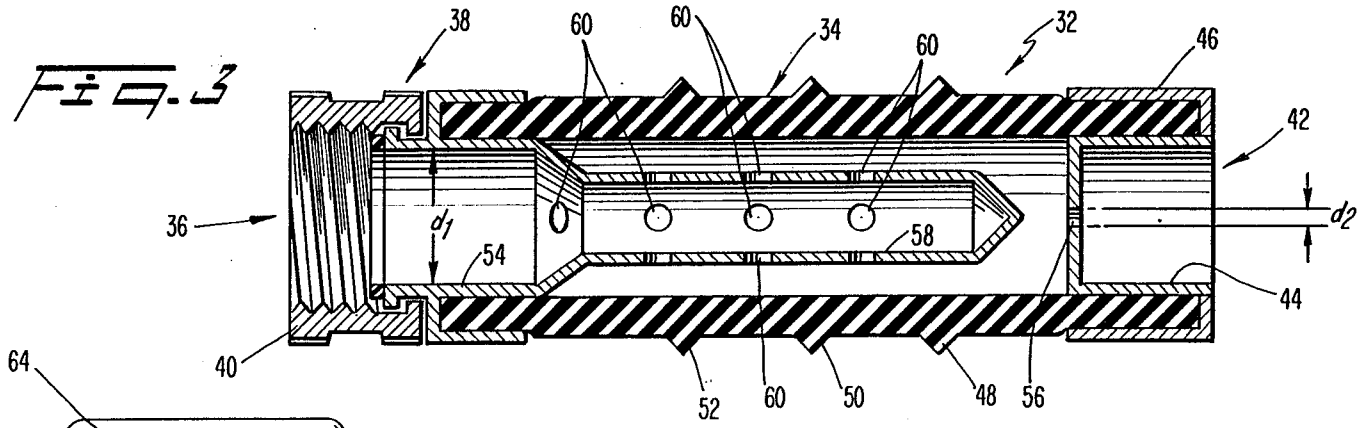
FIG. 3 is a side cross-sectional view of an apparatus constructed in accordance with a first embodiment of the invention.

An example of a known drain cleaning device is illustrated in FIG. 1. The known device 10 includes a hollow generally cylindrical bladder 12 made of rubber or the like. A female hose connection 14 is provided at an inlet end 15 of the bladder 12 for permitting connection of the device to a ½ or ¾ inch garden hose as is available in most homes. The connection includes a threaded female connection piece 16 and an inner cylindrical connection mount 18. Also provided at the inlet end of the bladder 12 is a rigid insert member 20 which is used to aid in the fastening of the rubber bladder to the connection.

A cylindrical orifice member 22 including an end wall 24 is fitted in the outlet end of the bladder 12 of the known device and is provided with an orifice 26 in the end wall 24. The orifice member 22 is held in the bladder 12 by a crimped ring piece 28 or the like. Thus, the known device includes a bladder 12 having an expandable middle section and two rigid end sections housing the inlet and outlet ends of the bladder.

In operation, the known device 10 is placed in a stopped-up drain with the orifice facing the clog and water is supplied to the expandable bladder. The water flows through the bladder 12 and out the orifice 26 toward the clog. This flow of water is supposed to cause a pressure build-up in the bladder 12 so as to force the expansion thereof. When the device operates in such a way that the bladder does expand, the bladder wall 30 engages the wall of the drain and no further water is permitted to get past the outside of the bladder in the upstream direction. By this operation, pressure builds up in the drain and the clog is cleared.

A disadvantage of this known type of device is realized by the frequent failure of the bladder to expand after water is supplied thereto, thus resulting in the device not operating in an advantageous manner and in the user being endangered with the prospect of being sprayed by water squirting out from around the sides of the bladder. In addition, even when a rag is placed around the device prior to water being supplied to the bladder, as has been attempted by some users, there remains a problem of spraying of water due to the failure of the bladder to expand and seal against the wall of the drain.

In order to overcome these disadvantages, as well as others, the present invention is constructed to ensure that the bladder expands reliably and that the expansion occurs prior to a time when a pressure build-up develops in the drain which is capable of causing spraying.

A preferred embodiment of the present invention is illustrated in FIGS. 2 and 3 of the drawing. As shown in FIG. 2, the inventive apparatus 32 includes a bladder 34 formed of rubber or the like which is connected at an inlet end 36 to a connection assembly 38 including a female connection member 40 adapted to fit on a conventional garden hose or any other pressurized fluid source.

At an outlet end 42 of the bladder 34 there is provided an inner orifice member 44 which is held at the outlet by an annular ring 46 crimped or otherwise fastened to the bladder 34 adjacent the outlet. Rings 48, 50, 52 are also provided on the bladder 34 and serve to hold the bladder in a drain during use of the device, as will be discussed more fully below.

In FIG. 3, the hose connection assembly 38 is illustrated as including a hollow connection mounting member 54 on which the female connection member 40 is rotatably supported. This connection mounting member extends axially of the bladder and defines an inlet of a given diameter d1. At the outlet end of the bladder, the orifice member 44 is secured by the ring 46 and is provided with an orifice 56 having a fixed diameter d2 which is sized relative to the inlet to ensure that pressure will build up in the bladder 34 when water is supplied thereto prior to the discharge of a substantial amount of water through the orifice 56. For example, for any given diameter d1 of the inlet, the orifice 56 may be designed small enough to restrict the flow of water through the bladder 34 so as to cause a pressure build-up in the bladder within in a desired amount of time when the water supply source is fully opened. For example, the orifice may have a diameter which is one-tenth the size of the inlet diameter or may be even smaller.

The connection mounting member 54 is closed off at the downstream end thereof by a rigid close-ended inner member 58 which is preferably either formed with the mounting member as illustrated or is formed separately and attached thereto. Within the inner member 58, several apertures 60 are provided which are directed radially outwardly of the inner member 58 and which act to direct fluid flow outwardly toward the expandable wall of the bladder 34. The area of each of the apertures 60 is such that the combined area of all of the apertures is at least as great as the area of the inlet.

This construction of the inner member 58 ensures that the difference between the diameters d1 and d2 of the inlet and the orifice 56 remains critical in establishing the timing of expansion of the bladder 34. If the apertures 60 are formed to have a combined area less than the area of the inlet, it is still possible to size the orifice 56 relative to the combined area of the apertures 60 to achieve the advantageous feature discussed wherein the pressure in the bladder 34 builds up quickly enough to cause expansion of the bladder before a substantial amount of water has passed through the orifice 56.

In operation, the inventive apparatus of FIG. 3 is placed into a drain, orifice end 42 first, while no water is supplied to the bladder 34. Once the apparatus 32 is properly positioned, water is supplied to the apparatus and pressure begins to build in the bladder 34. During this short period, some water is discharged from the orifice 56 and is directed to the clog in the drain. However, there is no substantial pressure build-up in the drain downstream of the orifice 56 since the orifice is sized to restrict the flow until sufficient pressure has built up within the bladder 34 to cause an increased velocity of water through the orifice.

When the pressure in the bladder 34 reaches a certain level, the expandable wall of the bladder expands outwardly to meet the wall of the drain. Due to the construction of the inner member 58 and the apertures 60 therein which direct the flow of water radially outwardly toward the expandable wall of the bladder, the pressure within the bladder 34 which must be reached to cause expansion thereof is reduced by an amount equal to the force exerted on the wall by the water flow. Thus, the speed with which the bladder is caused to expand is further increased.

Under the increased internal pressure within the bladder 34, water is forced through the orifice 56 at a much accelerated speed and is directed at the clog. Soon after the bladder has expanded against the wall of the drain, the steady state of the apparatus 32 is achieved and the clog in the drain is subjected to a constant pressure near to that of the water source. The rings 48, 50, 52 on the outer surface of the bladder are pressed against the wall of the drain by the pressure within the expanded bladder and hold the bladder in place in the drain while the clearing operation is completed. The rings may be formed of any cross-sectional shape which tends to perform this function of holding the bladder in the drain when the bladder is expanded.

Several advantageous results are thus realized by use of the inventive apparatus. For example, due to the pressure build-up within the bladder 34 which occurs prior to any build-up of pressure in the drain, the bladder is given time to expand without a risk of pressurized water escaping back up through the space between the apparatus and the wall of the drain. In addition, the expansion of the bladder occurs more quickly than in conventional devices and, therefore, increases the speed with which desirable results are achieved with the inventive apparatus.

Figure 4:
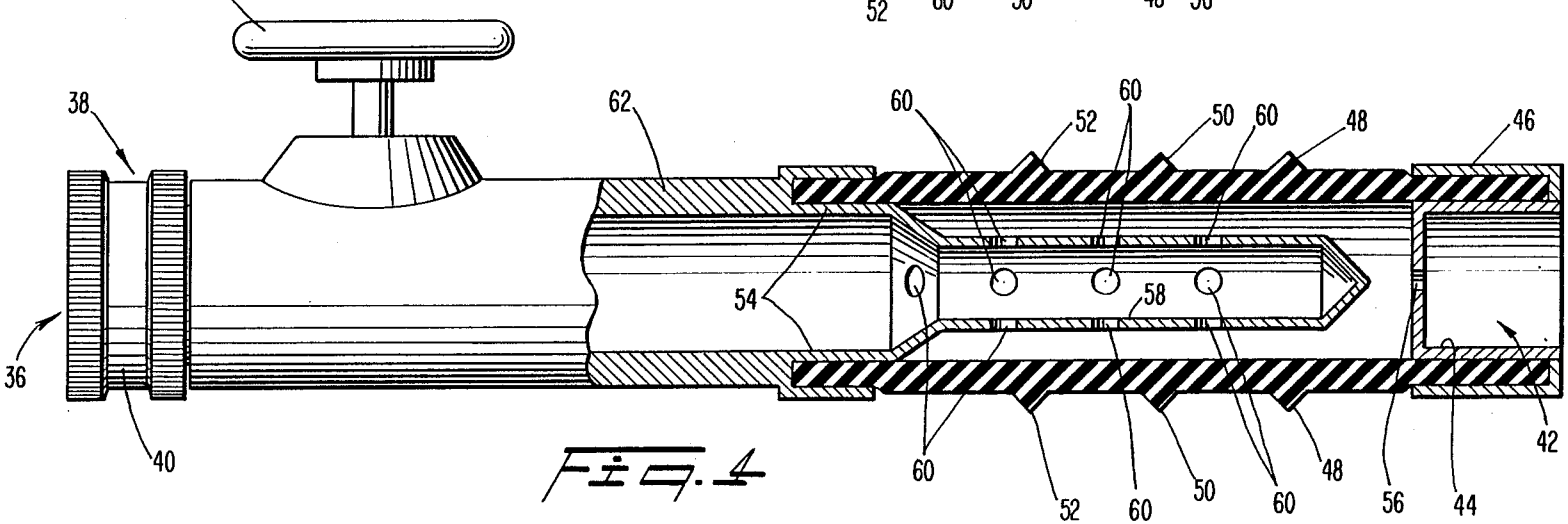
FIG. 4 is a side view, partially in section, of an apparatus constructed in accordance with the first embodiment and including further modifications.

Certain modifications of the above-described embodiment of the invention are illustrated in FIG. 4. For example, at the inlet end 36 of the bladder 34, the connection mounting member 54 may be provided with an extended section 62 having an increased thickness so as to present a handle to the user for simplifying handling of the apparatus 32. In addition, a valve 64 such as a quarter-turn valve may be formed in the handle 62 to permit the water supply to the bladder 34 to be controlled at the apparatus after the supply has been turned on at the water source. Such a construction permits a single user to operate the valve at the water source and to place and hold the apparatus in the drain, thus simplifying the procedure to be followed in operating the apparatus.

Figure 5:
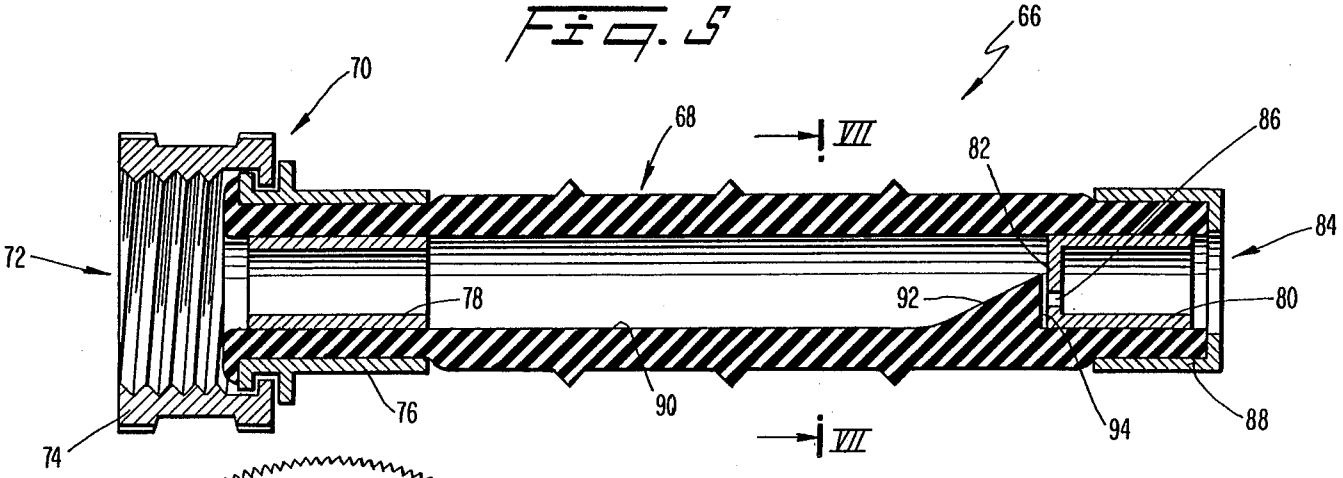
FIG. 5 is a side cross-sectional view of an apparatus constructed in accordance with a further embodiment of the invention.
Figure 7:
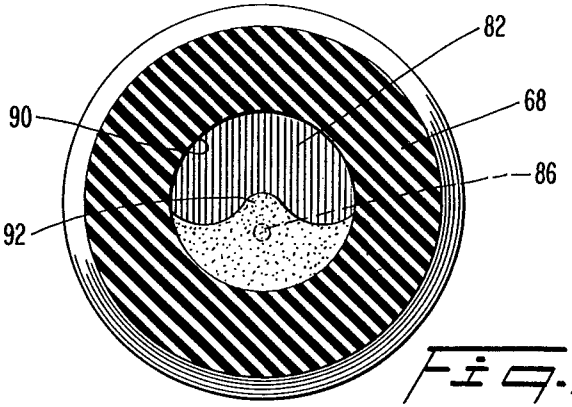
FIG. 7 is a sectional view taken along line VII —VII of FIG. 6.
Figure 6:
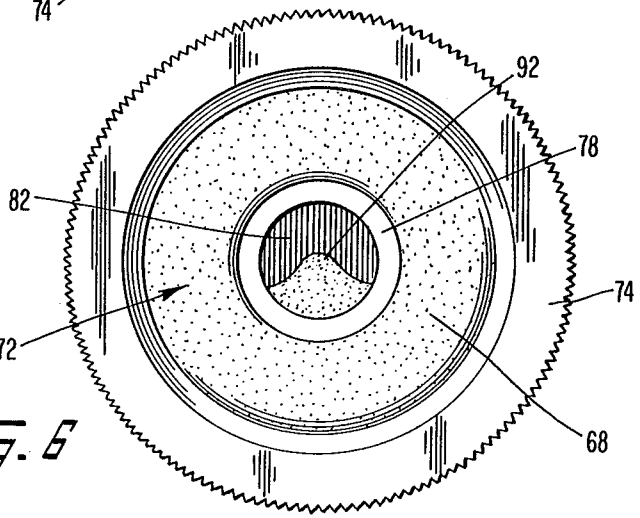
FIG. 6 is an end view of the apparatus of FIG. 5.

A further embodiment of the present invention is shown in FIGS. 5–7. As illustrated in FIG. 5, the apparatus 66 is similar to the apparatus 10 known in the art in several respects. However, it should be understood that this second embodiment could include any or all of the features of the first embodiment illustrated above in FIGS. 2–4, and that the unique features of the second embodiment are discussed separately to emphasize that the apparatus 66 of the second embodiment need not be combined with the first embodiment to achieve the objects of the invention.

The apparatus 66 of the second embodiment includes a hollow generally cylindrical bladder 68 made of rubber or the like having a female hose connection 70 provided at an inlet end 72 thereof for permitting connection of the apparatus 66 to a conventionally sized garden hose as is available in most homes. The connection 70 includes a threaded female connection piece 74 and a connection mounting member 76. A rigid insert member 78 may also be provided at the inlet end 72 of the bladder 68 which is used to aid in the fastening of the rubber bladder to the connection since the diameter of the inlet is not critical in this second embodiment.

A cylindrical orifice member 80 including an end wall 82 is fitted in the outlet end 84 of the bladder of the apparatus 66 and the end wall 82 is provided with an orifice 86. The orifice member 80 is held in the bladder 68 by a crimped ring piece 88 or the like which preferably extends a shorter distance axially inwardly from the outlet end 84 of the bladder than the distance over which the orifice member 80 extends.

The bladder 68 includes an expandable wall having an inner surface 90 which is generally cylindrical but which is provided with a valve means in the form of a lip 92 extending radially inwardly of the wall at a position adjacent the orifice 86 in the end wall 82. The lip 92 includes a flat surface 94 adjacent the orifice member 80 which is adapted to rest flush against the end wall 82 so as to cover the orifice 86 in the unexpanded condition of the bladder 68 shown in FIG. 5.

As shown in FIGS. 6 and 7, the lip 92 extends radially inwardly of the bladder a distance sufficient to cover the orifice 86, and extends around preferably less than one half of the circumference of the bladder. The positioning of the lip 92 relative to the orifice 86 is illustrated in FIGS. 5 and 7.

By this construction, several advantages are achieved. For example, during use, water supplied to the apparatus enters the bladder 68 and is prevented from being discharged therefrom by the closed valve condition created by the lip 92 covering the orifice 86. Pressure is built-up quickly in the bladder 68 and expansion is initiated before any water is permitted to exit the bladder. Once expansion begins, the lip 92 is pulled away from the orifice 86 by the movement of the expandable wall radially outwardly toward the drain wall, and the orifice 92 is uncovered. Thereafter, water is discharged from the orifice 92 at a high velocity and is directed at the clog. In addition, as water is discharged, pressure builds up in the drain and the clog is subjected to a high pressure urging the clog downstream.

While this invention has been illustrated and described in accordance with a preferred embodiment, it is recognized that variations and changes may be made and equivalents employed herein without departing from the invention as set forth in the claims.

What is claimed is:

1. An apparatus for use in delivering fluid under pressure to a drain of a given diameter, comprising:

a bladder having an inlet end, an outlet end and an expandable wall having an outer diameter which is smaller than the given diameter of the drain when the bladder is unexpanded, the inlet end including an inlet having a fixed inlet diameter;

supply connection means for connecting the apparatus to a fluid supply source which supplies fluid under pressure to the inlet;

an orifice having a fixed orifice diameter and being located at the outlet end of the bladder, the orifice diameter being small relative to the inlet diameter so that a pressure buildup develops in the bladder sufficient to cause the expansion of the expandable wall when fluid is supplied to the bladder; and flow directing means for directing the flow of fluid radially outwardly within the bladder toward the expandable wall whereby the expansion of the expandable wall of the bladder is facilitated by said radially directed flow, said flow directing means including a rigid hollow cylinder extending from the inlet end of the bladder toward the outlet end of the bladder, said rigid hollow cylinder having a cylindrical wall with a plurality of apertures adapted to direct fluid flowing from the inlet of the bladder radially outwardly toward the expandable wall of the bladder, said rigid hollow cylinder terminating at a closed end opposite the inlet.

2. The apparatus according to claim 1, wherein the plurality of apertures have a combined area which is at least as great as the area of the inlet.

3. The apparatus according to claim 1, further comprising a valve adjacent the inlet for controlling flow to the bladder.

4. The apparatus according to claim 1, wherein the apparatus is shaped to form a handle by which the apparatus may be held.

5. An apparatus for use in delivering fluid under pressure to a drain of a given diameter, comprising:

a bladder having an inlet end, an outlet end and an expandable wall having an outer diameter which is smaller than the given diameter of the drain when the bladder is unexpanded, the inlet end including an inlet having a fixed inlet diameter, said outlet end being not rigidly connected to said inlet to facilitate the expandability of said bladder;

supply connection means for connecting the apparatus to a fluid supply source which supplies fluid under pressure to the inlet;

an orifice having a fixed orifice diameter and being located at the outlet end of the bladder, the orifice diameter being small relative to the inlet diameter so that a pressure buildup develops in the bladder sufficient to cause the expansion of the expandable wall when fluid is supplied to the bladder; and flow directing means for directing the flow of fluid radially outwardly within the bladder toward the expandable wall whereby the expansion of the expandable wall of the bladder is facilitated by said radially directed flow.

6. The apparatus according to claim 5, wherein the flow directing means includes a rigid inner member extending from the inlet end of the bladder toward the outlet end of the bladder, the inner member including flow directing passages for directing fluid flow radially outwardly toward the expandable wall of the bladder.

7. The apparatus according to claim 6, wherein the inner member is a hollow cylinder having a closed end opposite the inlet and a cylindrical wall provided with a plurality of apertures adapted to direct fluid flowing from the inlet of the bladder radially outwardly toward the expandable wall of the bladder.

8. The apparatus according to claim 7, wherein the plurality of apertures have a combined area which is at least as great as the area of the inlet.

9. The apparatus according to claim 5, further comprising a valve adjacent the inlet for controlling flow to the bladder.

10. The apparatus according to claim 5, wherein the apparatus is shaped to form a handle by which the apparatus may be held.

11. The apparatus according to claim 1, wherein said outlet end is restricted from movement relative to said inlet only by said bladder.

* * * * *